US011774914B2

(12) United States Patent
Cusin et al.

(10) Patent No.: US 11,774,914 B2
(45) Date of Patent: Oct. 3, 2023

(54) METHOD FOR MANUFACTURING A ONE-PIECE SILICON DEVICE WITH FLEXIBLE BLADES, IN PARTICULAR FOR TIMEPIECES

(71) Applicant: Nivarox-FAR S.A., Le Locle (CH)

(72) Inventors: Pierre Cusin, Villars-Burquin (CH); Alex Gandelhman, Colombier (CH)

(73) Assignee: Nivarox-FAR S.A., Le Locle (CH)

( * ) Notice: Subject to any disclaimer, the term of this patent is extended or adjusted under 35 U.S.C. 154(b) by 371 days.

(21) Appl. No.: 17/149,112

(22) Filed: Jan. 14, 2021

(65) Prior Publication Data

US 2021/0247721 A1 Aug. 12, 2021

(30) Foreign Application Priority Data

Feb. 12, 2020 (EP) ..... 20156902

(51) Int. Cl.
*G04B 17/04* (2006.01)
*G04D 3/00* (2006.01)

(52) U.S. Cl.
CPC ..... *G04D 3/0069* (2013.01); *G04B 17/045* (2013.01)

(58) Field of Classification Search
CPC .. G04B 17/045; G04B 3/0069; G04B 17/066; G04B 17/06; G04D 3/0069
See application file for complete search history.

(56) References Cited

U.S. PATENT DOCUMENTS 11,454,932 B2 * 9/2022 Di Domenico ..... G04B 31/06
2013/0230939 A1 9/2013 Lee
2015/0203985 A1 * 7/2015 Stranczl ..... G04B 15/12 117/9
2015/0234354 A1 * 8/2015 Henein ..... G04B 17/045 368/170
2018/0143591 A1 5/2018 Di Domenico et al.
2018/0372150 A1 * 12/2018 Papi ..... G04B 15/14
2020/0033804 A1 1/2020 Di Domenico et al.
2020/0379408 A1 * 12/2020 Despont ..... G04B 17/066
(Continued)

FOREIGN PATENT DOCUMENTS

CH 703464 A2 1/2012
CH 713329 * 12/2016
(Continued)

OTHER PUBLICATIONS

European Search Report of EP20156902 dated Jul. 29, 2020.

*Primary Examiner* — Sean Kayes
(74) *Attorney, Agent, or Firm* — Sughrue Mion, PLLC

(57) ABSTRACT

A one-piece silicon device with flexible blades (2, 3), in particular for timepieces, for example a pivot with crossed blades, and to a method for manufacturing the device (1). The method includes: forming (21) a one-piece silicon device (1) blank from a wafer of the SOI type, the device (1) including two flexible blades (2, 3), each formed in a different layer of the SOI wafer, the blades (2, 3) being arranged in two different substantially parallel planes, the blades (2, 3) being separated by a clearance (7); growing a first silicon oxide layer on the surface of at least one of the blades (2, 3) bordering the clearance, the first silicon oxide layer being formed from a first sub-layer of silicon of the one or more blades (2, 3); and removing the first silicon oxide layer to increase the clearance (7) between the two blades (2, 3).

16 Claims, 3 Drawing Sheets

(56) References Cited

U.S. PATENT DOCUMENTS

| | | | | |
|---|---|---|---|---|
| 2021/0026299 | A1* | 1/2021 | Jeanneret | G04B 17/22 |
| 2021/0055695 | A1* | 2/2021 | Huot-Marchand | G04B 17/045 |

FOREIGN PATENT DOCUMENTS

| | | | |
|---|---|---|---|
| CH | 711 828 | A2 | 5/2017 |
| CN | 103288043 | A | 9/2013 |
| CN | 110780576 | A | 2/2020 |
| EP | 3326963 | A1 | 5/2018 |
| EP | 3435172 | A2 | 1/2019 |
| JP | 2018-84577 | A | 5/2018 |
| JP | 2020-16646 | A | 1/2020 |
| TW | 200713521 | A | 4/2007 |
| WO | 2014/023584 | A1 | 2/2014 |
| WO | 2019/166922 | A1 | 9/2019 |

* cited by examiner

METHOD FOR MANUFACTURING A ONE-PIECE SILICON DEVICE WITH FLEXIBLE BLADES, IN PARTICULAR FOR TIMEPIECES

CROSS REFERENCE TO RELATED APPLICATIONS

This application is claiming priority based on European Patent Application No. 20156902.7 filed on Feb. 12, 2020. The content of which is incorporated herein by reference.

FIELD OF THE INVENTION

The invention relates to a method for manufacturing a one-piece silicon device with flexible blades, in particular for timepieces, for example a pivot with crossed blades used as a compensator cooperating with a known inertial balance to form a resonator having a predetermined frequency.

BACKGROUND OF THE INVENTION

Oscillators based on flexible blades are quite often made of silicon and thus benefit from the performance levels of this material as regards micromachining (DRIE). One specific category of these oscillators is that of pivots with so-called "crossed blades", for which two blades are formed in two separate layers of two substantially parallel planes and cross one another. These pivots allow an element, for example a balance of an oscillating mechanism or a pallet-lever of an escapement mechanism, to rotatably oscillate.

Such pivots can be manufactured in different ways. A first method consists of manufacturing the two blades separately and assembling them together while leaving a clearance between the blades. Such a method allows a sufficient clearance between the blades to be chosen in order to prevent them from knocking against one another. However, the arrangement of the blades in relation to one another is not always precise, which reduces the performance levels of the pivot as regards chronometry.

A second method consists of manufacturing a one-piece pivot by machining two layers of an SOI-type silicon wafer. This method is very effective for arranging the blades in relation to one another, however it does not allow for a sufficiently wide safety clearance between the blades to prevent them from knocking against one another when the pivot is in operation. More specifically, the clearance depends on the thickness of the oxide bonding the two layers of the SOI wafer, the thickness being far less than the required safety clearance.

SUMMARY OF THE INVENTION

The purpose of the present invention is to overcome all or part of the aforementioned drawbacks by proposing a method for manufacturing a one-piece silicon device with flexible blades, for which the safety clearance between the planes of the blades is sufficient, in particular as regards the width thereof.

For this purpose, the invention relates to a method for manufacturing a one-piece silicon device with flexible blades, in particular for timepieces, for example a pivot with crossed blades, the method comprising the following steps of:

forming a one-piece silicon device blank from a wafer of the SOI type, the device comprising two flexible blades, each formed in a different layer of the SOI wafer, the blades being arranged in two different substantially parallel planes, the blades being separated by a clearance, growing a first silicon oxide layer on the surface of at least one of the blades bordering the clearance, the first silicon oxide layer being formed from a first sub-layer of silicon of the one or more blades, removing the first silicon oxide layer to increase the clearance between the two blades.

A device with flexible blades is thus obtained, for example a pivot with crossed blades, having a sufficient safety clearance between the blades to prevent the blades from colliding while the device is in operation. More specifically, when a silicon oxide layer grows on silicon, a sub-layer of silicon is itself oxidised, such that when the silicon oxide layer is removed by etching, the sub-layer of silicon is eliminated from the initial silicon mass. The final silicon volume is thus reduced compared to the initial silicon volume.

Thus, via this effect, the clearance between the blades can be increased by repeating the operations consisting of growing the silicon oxide then removing the silicon oxide layer. Each time the silicon oxide layer is removed, the clearance increases.

According to one specific embodiment of the invention, the method comprises the following steps of:

growing a second silicon oxide layer on the surface of at least one of the blades bordering the clearance, the second silicon oxide layer being formed from a second sub-layer of silicon of the one or more blades, removing the second silicon oxide layer to further increase the clearance between the two blades.

According to one specific embodiment of the invention, the successive steps of growing silicon oxide layers and of removing the layer are repeated several times to increase the clearance between the two blades in order to reach a desired width.

According to one specific embodiment of the invention, the device blank comprises crossed blades joined at the crossover point by a join, the join being at least partially made of silicon oxide, the method comprising a step of removing the silicon oxide from the join between the blades to separate same by creating said clearance between the blades.

According to one specific embodiment of the invention, each silicon oxide layer is removed by etching using hydrogen fluoride in the vapour phase.

According to one specific embodiment of the invention, the silicon oxide is grown by wet or dry thermal oxidation of the silicon.

According to one specific embodiment of the invention, the device blank is produced by deep reactive ion etching (DRIE), for example by chemical etching.

According to one specific embodiment of the invention, each growth and removal of a silicon oxide layer enables a sub-layer of silicon that is at least 0.10 μm thick, preferably at least 0.40 μm thick, to be eliminated from a blade.

According to one specific embodiment of the invention, the method comprises an additional step of growing an additional oxide layer on the device to thermally adjust the stiffness of the device as a function of temperature, in particular to temperature-compensate an oscillator formed by a balance pivot assembly, and/or to reinforce the device.

According to one specific embodiment of the invention, the method comprises an additional step of depositing an electrically conducting layer to avoid problems related to the accumulation of electrostatic charges or moisture absorption.

According to one specific embodiment of the invention, the method comprises a step of determining the initial stiffness of the device and of calculating the dimensions thereof to obtain a pivot having a desired final stiffness.

According to one specific embodiment of the invention, the step of forming the device blank comprises the following sub-steps of:

- procuring an SOI wafer successively comprising a first silicon layer, a silicon oxide bonding layer, and a second silicon layer;
- growing a silicon oxide layer on the surface of the wafer;
- etching the silicon oxide layer on a first side of the wafer through a mask formed beforehand;
- carrying out a deep reactive ion etching process to form at least a first blade of the one-piece silicon device with flexible blades;
- etching the silicon oxide layer on a second side of the wafer through a second mask formed beforehand, preferably aligned with the patterns formed on the first side of the wafer;
- carrying out a deep reactive ion etching process to form at least a second blade of the one-piece silicon device with flexible blades.

According to one specific embodiment of the invention, the width of the minimum clearance obtained between the blades after the steps of the method is greater than 10 μm, preferably greater than 15 μm.

The invention further relates to a device with flexible blades made of silicon, in particular for timepieces, for example a pivot comprising two crossed blades, the device being made in one piece and obtained by the method according to the invention, the two blades being separated by a safety clearance, the width whereof is greater than 10 μm, preferably greater than 15 μm.

The invention further relates to a horological movement comprising such a device with flexible blades.

BRIEF DESCRIPTION OF THE DRAWINGS

Other specific features and advantages will be clearly observed in the following description, which is given as a rough guide and in no way as a limited guide, with reference to the accompanying figures, wherein.

DETAILED DESCRIPTION OF THE PREFERRED EMBODIMENTS

Figure 1:
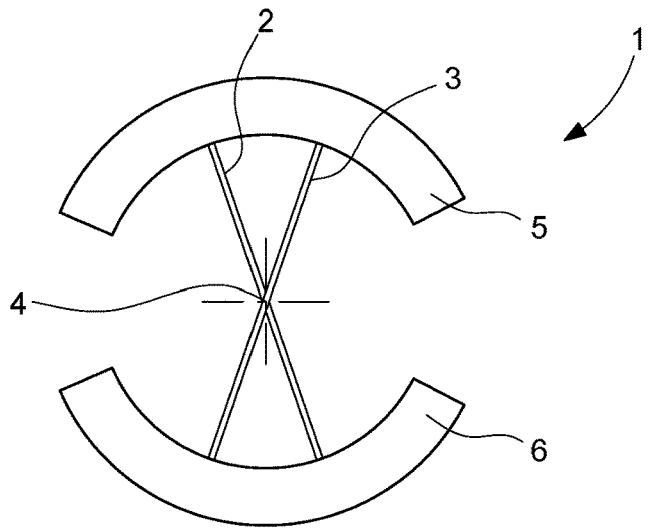
FIG. 1 is an overhead view of a pivot with crossed blades according to the invention.
Figure 2:
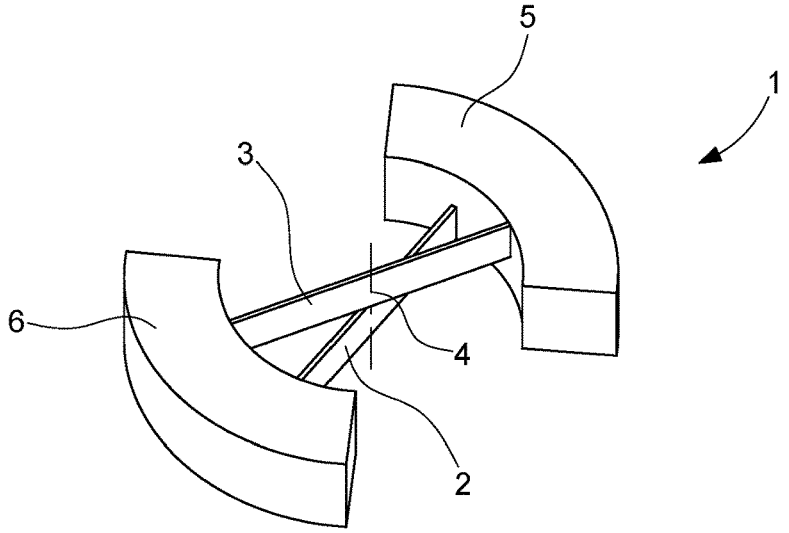
FIG. 2 is a perspective view of a pivot with crossed blades according to the invention.
Figure 3:
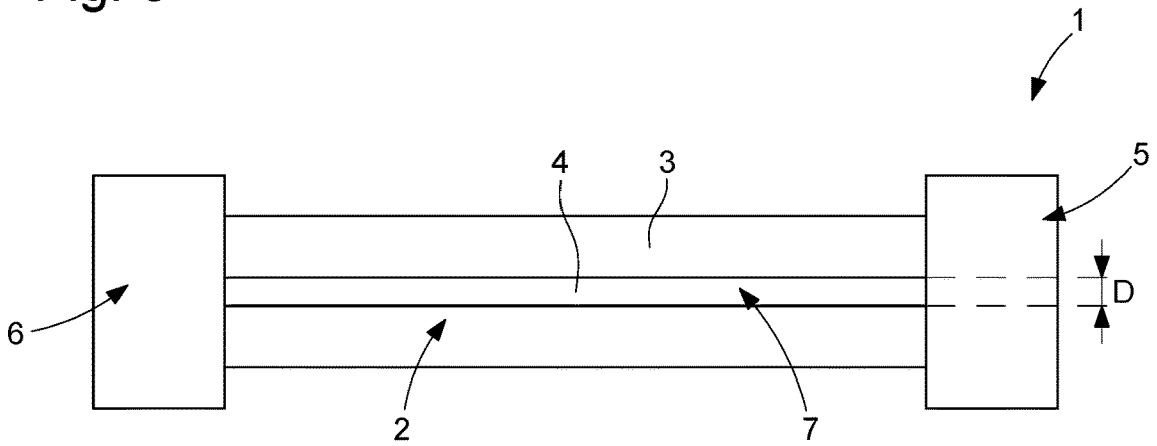
FIG. 3 is a side view of a pivot with crossed blades obtained by the method according to the invention.

The invention relates to a one-piece silicon device with flexible blades, in particular for timepieces, in particular a pivot with crossed blades 1 as shown in FIGS. 1 to 3, and the manufacturing method thereof making it possible to obtain a one-piece pivot with a clearance between the blades which is sufficiently wide to prevent the blades from knocking against one another during use.

Such a pivot 1 includes a first element 5 and a second element 6, as well as two crossed blades 2, 3, the two crossed blades 2, 3 connecting the two elements 5, 6 to one another. The two blades 2, 3 are connected to each element 5, 6, the pivot 1 being made in one piece. The first element 5 is, for example, a support for fastening the pivot to the horological movement, and the second element 6 is a component that must be pivoted. Such a component is, for example, an escapement pallet-lever, a balance or a balance support of a horological movement. The two blades 2, 3 cross paths between the two elements 5, 6 at a crossover point 4. Thanks to the flexible blades 2, 3, the second element 6 is capable of moving relative to the first element 5 about a virtual axis. Thus, the first element 5 is stationary on the horological movement, whereas the second element 6 undergoes a periodic to-and-fro motion. The blades 2, 3 bend sideways to allow the second element 6 to move in one direction, then in the other direction.

The blades 2, 3 are arranged in two parallel planes separated by a minimum clearance 7 to prevent the blades 2, 3 from knocking against one another during operation of the flexible pivot, in particular in the event of spurious deformation.

The use of a material, for example a silicon-based material, for manufacturing a pivot 1 offers the advantage of being precise using existing etching methods and of having good mechanical and chemical properties, in particular having little or no sensitivity to magnetic fields.

Preferentially, the silicon-based material used can be monocrystalline silicon, regardless of the crystal orientation thereof, doped monocrystalline silicon, regardless of the crystal orientation thereof, amorphous silicon, porous silicon, polycrystalline silicon, silicon nitride, silicon carbide, quartz, regardless of the crystal orientation thereof, or silicon oxide.

Figure 4:
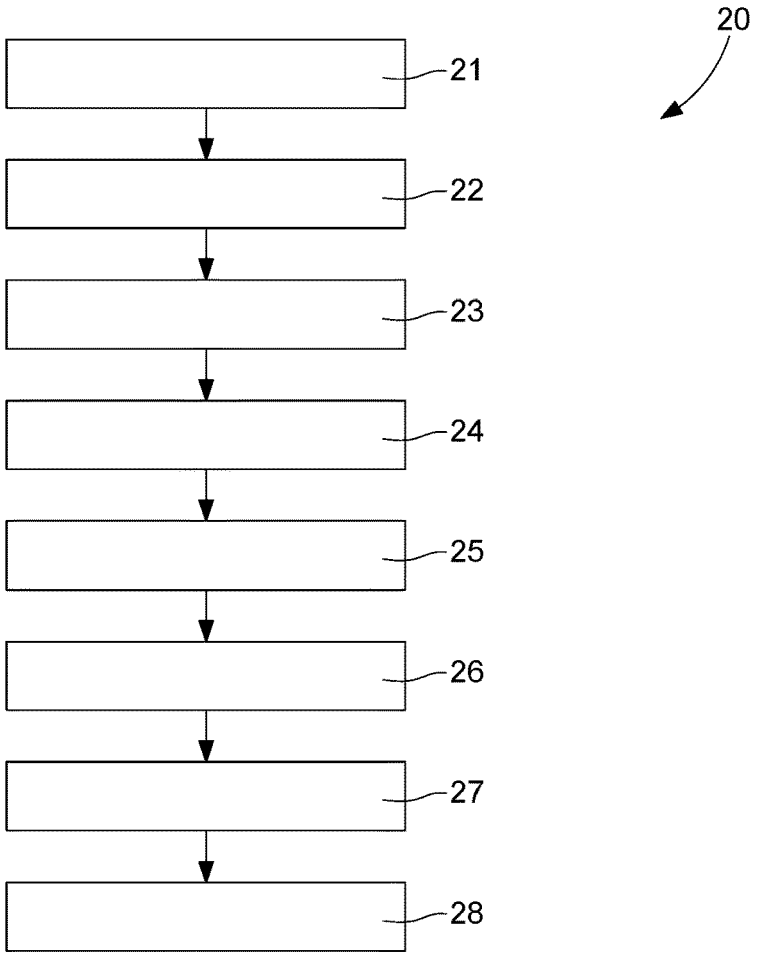
FIG. 4 is a block diagram showing the different steps of a method for manufacturing a one-piece flexible silicon pivot with crossed blades according to the invention.

Thus, the invention relates to a method 20 for manufacturing a pivot 1 with flexible crossed blades 2, 3 made of silicon, in particular for timepieces, as shown in FIG. 4.

Figure 5:
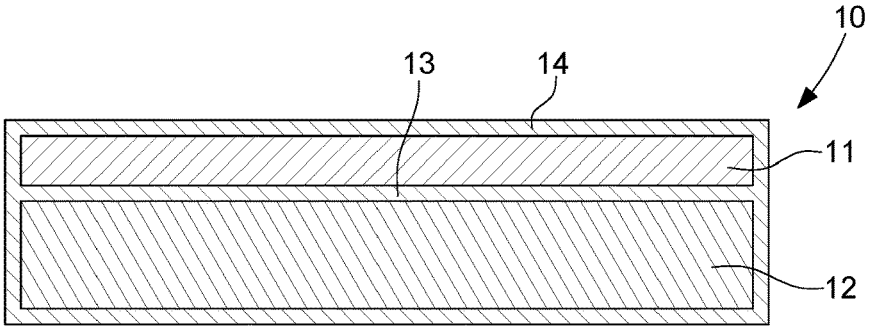
FIG. 5 shows a sectional view of a wafer that can be used to manufacture the pivot.

The method 20 includes a first step 21 of manufacturing a silicon pivot blank. This step 21 consists of procuring SOI wafers 10, as shown in FIG. 5, which are composed of two silicon layers 11 and 12, bonded together by a first silicon oxide layer 13. The silicon layers 11, 12 are formed in a monocrystalline silicon plate (the main orientations whereof can vary). Each silicon layer 11, 12 will allow a different blade of the pivot 1 with crossed blades 2, 3 to be manufactured. Thus, the blades 2, 3 are arranged at two different levels. The first oxide layer 13 is used to closely bond the two silicon layers 11 and 12. Moreover, it will also be used as a barrier layer in subsequent operations.

A plurality of pivot blanks can be formed in the same wafer.

Subsequently, a second silicon oxide layer 14 is grown on the surface of the silicon layers 11, 12 by exposing the one or more wafers to a high-temperature oxidising atmosphere. The silicon oxide layer 14 varies according to the thickness of the silicon layer 11, 12 to be patterned. It is typically between 1 and 4 μm.

Subsequently, the patterns to be produced thereafter in the silicon wafer 10 using a mask will be defined, for example in a positive photoresist. The pattern comprises at least one blade of the pivot. The two blades of a same pivot are each produced on one of the two separate silicon layers 11, 12. The blades are produced one after the other.

This step 21 comprises the following operations of:

depositing the photoresist, for example by spin coating, in a very thin layer having a thickness comprised between 1 and 2 μm, once dry, exposing this photoresist, having photolithographic properties, through a photolithographic mask (transparent plate covered with a chromium layer, itself representing the desired patterns) using a light source;

in the specific case of a positive photoresist, removing the exposed areas of the photoresist using a solvent, thus revealing the first oxide layer 13. In this case, the areas still covered with photoresist define the areas that are not to be etched in the subsequent silicon deep reactive ion etching process (also known as "D.R.I.E.").

The exposed or conversely the photoresist-covered areas are thus exploited. A first etching process allows the patterns defined in the photoresist in the previous steps to be transferred to the silicon oxide 14 grown beforehand. Still with a view to the repeatability of the manufacturing process, the silicon oxide is patterned by dry plasma etching, which is directional and reproduces the quality of the sidewalls of the photoresist used as a mask for this operation.

Masks can also be used directly on the wafer, which masks are referred to as hard-masks, such as silicon oxide, silicon nitride or metal masks. These masks are patterned beforehand with the appropriate pattern and may or may not comprise photoresist during the use thereof.

Once the silicon oxide has been etched in the open areas of the photoresist, the silicon surface of the first top layer 11 is thus exposed and ready for DRIE. The photoresist may or may not be preserved depending on whether or not the photoresist is to be used as a mask during DRIE.

The silicon that is exposed and not protected by the silicon oxide is etched in a direction perpendicular to the surface of the wafer (Bosch® anisotropic DRIE). The blade patterns formed firstly in the photoresist and then in the silicon oxide are "projected" into the thickness of the layer 11.

When the etching opens out into the first silicon oxide layer 13 bonding the two silicon layers 11 and 12, the etching stops. More specifically, following the example of the silicon oxide, which acts as a mask in the Bosch® process and is resistant to the etching process itself, the buried oxide layer 13, of the same nature, is also resistant thereto.

The first silicon layer 11 is thus patterned throughout the thickness thereof by the defined patterns representing at least a first blade of the pivot blank to be manufactured, now revealed by this DRIE. Chemical etching could also be used in the same silicon-based material.

The blades remain rigidly connected to the second silicon layer 12 to which they are bonded by the first buried silicon oxide layer 13.

The same photolithographic operations are carried out on the second silicon layer 12 to form the other blade of the pivot with crossed blades. For this purpose, the wafer 10 is turned over, the photoresist is deposited thereon and is then exposed through a mask, in order to pattern the second silicon layer 12 in a manner similar to the first layer 11.

Other alternative embodiments exist for etching the wafer, which can of course be used for this method, either with photoresist masks or so-called hard-masks.

The first and second elements 5, 6 of the pivot 1 are preferably also formed during the manufacture of the blades 2, 3 on each silicon layer 11, 12 of the wafer 10.

Figure 6:
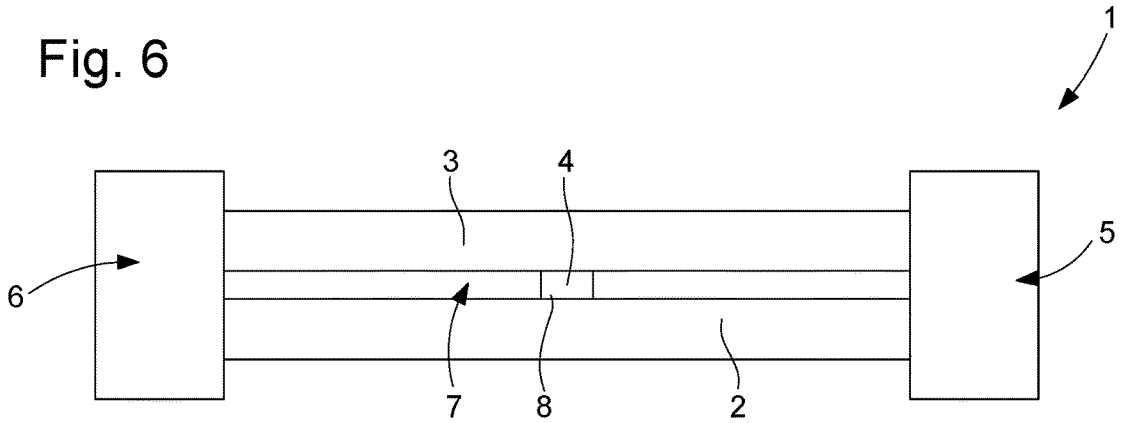
FIG. 6 shows a side view of a pivot with crossed blades obtained after the first step of the method according to the invention.
Figure 7:
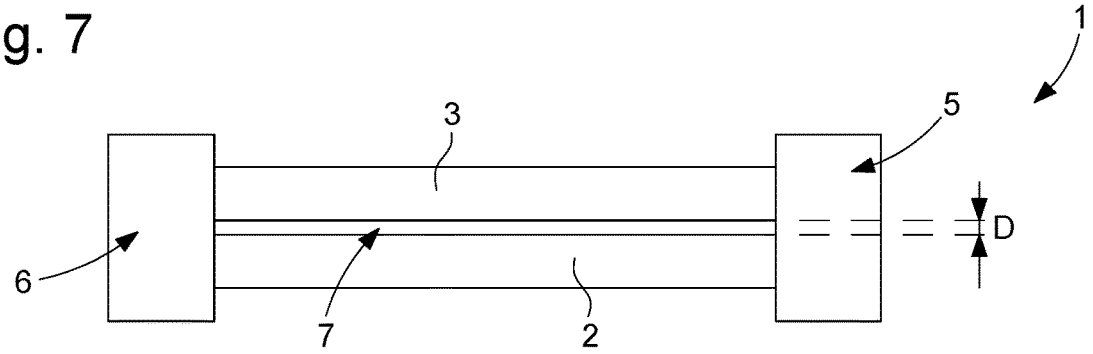
FIG. 7 shows a side view of a pivot with crossed blades obtained after the second step of the method according to the invention.
Figure 8:
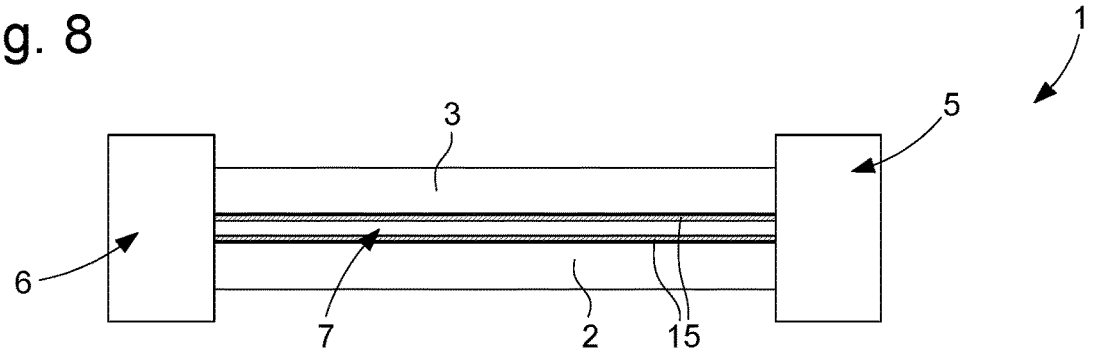
FIG. 8 shows a side view of a pivot with crossed blades obtained after the third step of the method according to the invention.

At this point, the two blades 2, 3 are joined together at the crossover point 4 of the blades 2, 3 in order to form a join 8. The join 8 at least partially contains silicon oxide from the silicon oxide layer 13 connecting the first and second silicon layers 11, 12. Preferably, the join 8 is made entirely of silicon oxide. The blank of the pivot 1 is shown in FIG. 6. The blades 2, 3 are arranged in two different substantially parallel planes, with the blades 2, 3 being joined between the two planes by the join 8.

A second step 22 of the method 20 consists of removing the silicon oxide at the join 8 of the blades 2, 3 to separate them by creating a clearance 7 between the blades 2, 3. The silicon oxide layer 13 is thus etched using hydrogen fluoride in the vapour phase.

As a result, two blades 2, 3 are obtained, separated by a clearance 7 allowing the blades to move relative to one another. The clearance 7 obtained has a width D corresponding to the thickness of the oxide layer of the join, and thus of the oxide layer of the wafer.

However, this thickness is not large enough to avoid the risk of the blades 2, 3 knocking against one another during the operation of the pivot 1. More specifically, the first silicon oxide layer 13 is too thin for the blades 2, 3 to be spaced sufficiently far apart.

The method 20 continues with a sequence designed to remove material from the blades until reaching the dimensions required to obtain a clearance 7 of sufficient width D and an adequate blade stiffness. To this end, the thickness of the blades 2, 3 is reduced in the following steps.

To increase the width D of the clearance 7 between the blades 2, 3, a third step 23 consists of growing a first silicon oxide layer 15 on the surface of the blades 2, 3 bordering the clearance 7. The first silicon oxide layer 15 is formed in part from a sub-layer of silicon forming the pivot 1. More specifically, when silicon oxide grows on the silicon, a sub-layer of silicon on which the silicon oxide is growing is itself oxidised. Thus, the silicon oxide grows at the expense of the silicon on which it grows. In other words, not only does the silicon oxide grow on the silicon, but it also grows in the silicon.

Such a phase can, for example, be obtained by thermal oxidation. Such a thermal oxidation process can, for example, be carried out between 800 and 1,200° C. in an oxidising atmosphere using water vapour or dioxygen gas to form silicon oxide on the blades. In this step 23, the fact that the silicon oxide grows in an even manner is exploited, and the resulting thickness and rate of oxidation are perfectly controlled by a person skilled in the art, thus ensuring the uniformity of the oxide layer.

Figure 9:
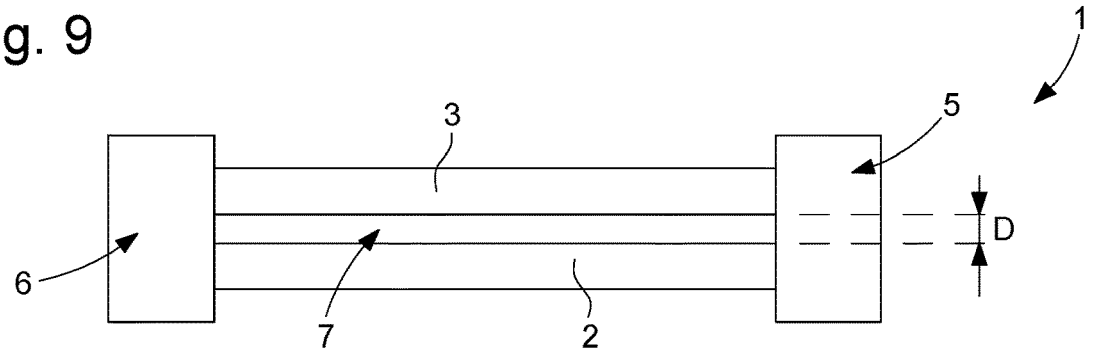
FIG. 9 shows a side view of a pivot with crossed blades obtained after the fourth step of the method according to the invention.

In a fourth step 24, the first silicon oxide layer 15 is removed from each blade 2, 3, to obtain the pivot 1 as shown in FIG. 9. Since the sub-layer of silicon has been oxidised, it is also removed. Thus, the clearance 7 between the two blades 2, 3 is increased. Such a removal process is achieved by chemical etching. Such chemical etching can be carried out, for example, using a hydrofluoric acid-based solution in the vapour phase, which allows the silicon oxide to be removed.

Preferably, the pairs of successive silicon oxide layer growth and oxide layer removal steps are repeated several times. Thus, the width D of the clearance 7 between the two blades 2, 3 can be increased to reach a desired clearance width.

Figure 10:
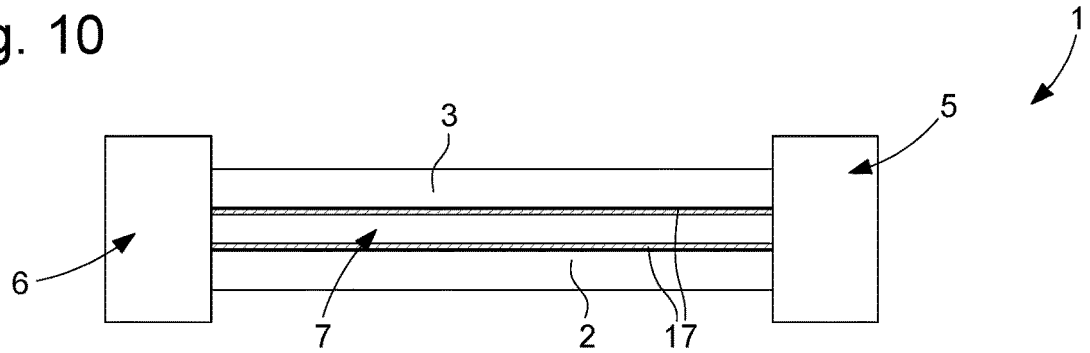
FIG. 10 shows a side view of a pivot with crossed blades obtained after the fifth step of the method according to the invention.
Figure 11:
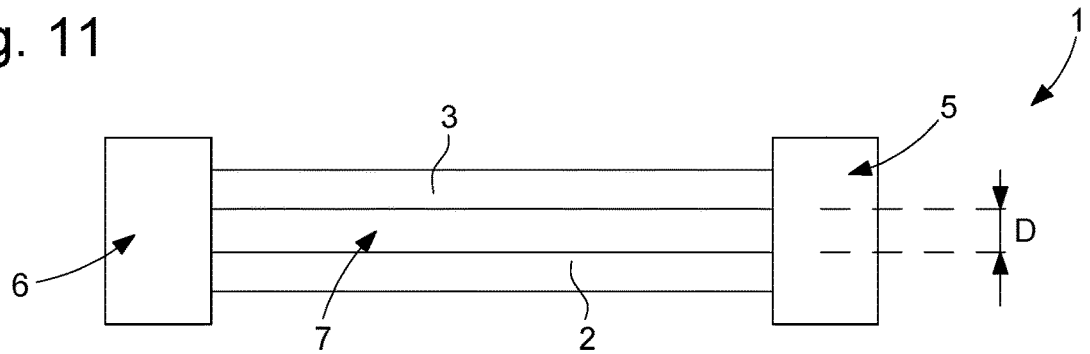
FIG. 11 shows a side view of a pivot with crossed blades obtained after the sixth step of the method according to the invention.

For example, as shown in FIG. 10, a fifth step 25 consists of growing a second silicon oxide layer 17 on the surface of the blades 2, 3 on either side of the clearance, the second silicon oxide layer 17 being partially formed by a second sub-layer of silicon of the blades 2, 3. Then, in a sixth step 26, the second silicon oxide layer 17 is removed from each blade 2, 3 to further increase the clearance 7 between the two blades 2, 3.

Each growth and removal of a silicon oxide layer enables, for example, a sub-layer of silicon that is at least 0.10 μm thick, preferably greater than 0.40 μm thick, to be eliminated from each blade 2, 3. The desired minimum width D of the clearance 7 between the blades 2, 3 after the steps of the method is, for example, greater than 10 μm, preferably greater than 15 μm. Nonetheless, the width can be adjusted freely between a value corresponding to the thickness of the initial oxide layer bonding the two silicon layers and a higher value that can reach beyond 15 μm, the higher value being limited by the number of operations that are to be performed.

The silicon oxide layer 13 of the wafer 10 at the start is, for example, 2 μm thick, which defines the initial clearance between the wafers 2, 3 after removing the join 8. Thus, in order to obtain a clearance of at least 10 μm, a plurality of pairs of silicon oxide growth and removal steps are carried out in series. To reduce the number of operations, the oxidation time of the blades can be increased such that a thicker sub-layer of silicon is eliminated. Preferably, shorter growth steps are carried out at the start and which become increasingly longer thereafter.

The method can further include an additional step 27 designed to determine the initial stiffness of the flexible blades, in particular so as to be able to modify the dimensions and obtain specific sought-after physical properties.

Finally, once the pivot 1 has been brought to the correct dimensions, another optional additional step 28 can consist of oxidising the pivot 1 again in order to coat it with a layer of silicon dioxide to form a pivot 1 that is thermo-compensated and/or to reinforce the pivot. In the case of an oscillator, this final oxidation allows both the mechanical performance (stiffness) and thermal performance (temperature compensation) of the future pivot 1 to be adjusted.

In another optional additional step, not shown in the figures, an electrically conducting layer is deposited on the pivot to avoid problems related to the accumulation of electrostatic charges or moisture absorption. For this purpose, an oxide layer is firstly deposited on the pivot 1, then the electrically conducting layer is deposited by a PVD-type process. The electrically conducting layer comprises, for example, chromium, nickel, copper, titanium, zirconium, nickel-phosphorus or titanium-tungsten.

It goes without saying that the present invention is not limited to the example shown but that various alternatives and modifications that may be apparent to a person skilled in the art can be made thereto. Other types of one-piece silicon devices with flexible blades can thus be produced, the device having, for example, uncrossed blades, and/or blades which are intended for translational motion instead of rotational motion.

The invention claimed is:

1. A method for manufacturing a one-piece silicon device with flexible blades for a timepiece, comprising the following steps of:

forming a one-piece silicon device blank from a wafer of the SOT type, the device comprising two flexible blades, each formed in a different layer of the SOI wafer, the blades being arranged in two different substantially parallel planes, the blades being separated by a clearance, growing a first silicon oxide layer on a surface of at least one of the blades bordering the clearance, the first silicon oxide layer being formed from a first sub-layer of silicon of the one or more blades, and removing (24) the first silicon oxide layer to increase the clearance between the two blades.

2. The manufacturing method according to claim 1, further comprising the following steps of:

growing a second silicon oxide layer on the surface of at least one of the blades bordering the clearance, the second silicon oxide layer being formed from a second sub-layer of silicon of the one or more blades, removing the second silicon oxide layer to further increase the clearance between the two blades.

3. The manufacturing method according to claim 1, wherein the successive steps of growing silicon oxide layers and of removing the layer are repeated several times to increase the clearance between the two blades in order to reach a desired width (D).

4. The manufacturing method according to claim 1, wherein the device blank comprises crossed blades joined at the crossover point by a join, the join being at least partially made of silicon oxide, the method comprising a step of removing the silicon oxide from the join between the blades to separate same by creating said clearance between the blades.

5. The manufacturing method according to claim 1, wherein each silicon oxide layer is removed by etching using hydrogen fluoride in the vapour phase.

6. The manufacturing method according to claim 1, wherein the silicon oxide is grown by wet or dry thermal oxidation of the silicon.

7. The manufacturing method according to claim 1, wherein the device blank is produced by deep reactive ion etching (DRIE).

8. The manufacturing method according to claim 1, wherein each growth and removal of a silicon oxide layer enables a sub-layer of silicon that is at least 0.10 μm thick to be eliminated from a blade.

9. The manufacturing method according to claim 1, further comprising an additional step of growing an additional oxide layer on the device to thermally adjust a stiffness of the device as a function of temperature, to temperature-compensate an oscillator formed by a balance pivot assembly, or to reinforce the device.

10. The manufacturing method according to claim 1, further comprising a step of determining an initial stiffness of a pivot with cross blades of the timepiece and of calculating a dimensions thereof to obtain a device of a desired final stiffness.

11. The manufacturing method according to claim 1, further comprising an additional step of depositing an electrically conducting layer.

12. The manufacturing method according to claim 1, wherein the step of forming the device blank comprises the following sub-steps of:

procuring an SOI wafer successively comprising a first silicon layer, a silicon oxide bonding layer, and a second silicon layer;

growing a silicon oxide layer on the surface of the wafer;

etching the silicon oxide layer on a first side of the wafer through a mask;

carrying out a deep reactive ion etching process to form at least a first blade of the one-piece silicon device with flexible blades;

etching the silicon oxide layer on a second side of the wafer through a second mask formed beforehand, aligned with patterns formed on the first side of the wafer; and carrying out a deep reactive ion etching process to form at least a second blade of the one-piece silicon device with flexible blades.

13. The manufacturing method according to claim 1, wherein a width (D) of the minimum clearance obtained between the blades after the steps of the method is greater than 10 μm.

14. A silicon device with flexible blades for a timepiece including a pivot comprising two crossed blades, the device being made in one piece, wherein the silicon device is obtained by the method according to claim 13, the two blades being separated by a safety clearance, the width whereof is greater than 10 μm.

15. The silicon device according to claim 14, wherein the width of the safety clearance is greater than 15 μm.

16. A horological movement, comprising a one-piece silicon device with flexible blades according to claim 14.

* * * * *